US006908403B1

(12) United States Patent
Hwang

(10) Patent No.: US 6,908,403 B1
(45) Date of Patent: Jun. 21, 2005

(54) GOLF BALL

(75) Inventor: In Hong Hwang, Namyangzu-Shi (KR)

(73) Assignee: Volvik Inc., (KR)

( * ) Notice: Subject to any disclaimer, the term of this patent is extended or adjusted under 35 U.S.C. 154(b) by 0 days.

(21) Appl. No.: 10/827,929

(22) Filed: Apr. 20, 2004

(30) Foreign Application Priority Data

Feb. 13, 2004 (KR) ..... 10-2004-009756

(51) Int. Cl.[7] ..... A63B 37/12

(52) U.S. Cl. ..... 473/383

(58) Field of Search ..... 473/378–385

(56) References Cited

U.S. PATENT DOCUMENTS 5,709,618 A * 1/1998 Hwang ..... 473/382
6,450,902 B1 * 9/2002 Hwang ..... 473/383

* cited by examiner

*Primary Examiner*—Raeann Gorden
(74) *Attorney, Agent, or Firm*—Amster, Rothstein & Ebenstein LLP

(57) ABSTRACT

Provided is a golf ball having a plurality of dimples that are arranged symmetrically even in a polygon of the polyhedron made by a new divided method of the spherical outer surface of the golf ball. The golf ball has an aerodynamic stability, so the landing point is stable and uniform and the carry distance has increased.

5 Claims, 3 Drawing Sheets

3-D COORDINATES

A = ( x : 0, y : 0.84, z : 0 )
B = ( x : 0.42, y : 0.727461, z : 0 )
C = ( x : 0.484974, y : 0.56, z : 0.39598 )
D = ( x : 0, y : 0.28, z : 0.79196 )
E = ( x : 0.727461, y : 0.42, z : 0 )
F = ( x : 0.42, y : 0.242487, z : 0.685857 )
G = ( x : 0.727461, y : 0.14, z : 0.39598 )
H = ( x : 0.84, y : 0, z : 0 )
I = ( x : 0.727461, y : − 0.42, z : 0 )
J = ( x : 0.42, y : − 0.727461, z : 0 )
K = ( x : 0.242487, y : − 0.7, z : 0.39598 )
L = ( x : 0, y : − 0.84, z : 0 )
M = ( x : − 0.242487, y : − 0.7, z : 0.39598 )
N = ( x : − 0.42, − 0.727461, z : 0 )
O = ( x : − 0.727461, y : − 0.42, z : 0 )
P = ( x : 0, y : 0, z : 0.84 )
Q = ( x : − 0.242487, y : − 0.14, z : 0.79196 )
R = ( x : − 0.84, y : 0, z : 0 )
S = ( x : − 0.727461, y : 0.14, z : 0.39598 )
T = ( x : − 0.42, y : 0.242487, z : 0.685857 )
U = ( x : − 0.727461, y : 0.42, z : 0 )
V = ( x : − 0.484974, y : 0.56, z : 0.39598 )
W = ( x : − 0.42, y : 0.727461, z : 0 )

3-D COORDINATES

A = ( x : 0, y : 0.84, z : 0 )
B = ( x : 0.42, y : 0.727461, z : 0 )
C = ( x : 0.484974, y : 0.56, z : 0.39598 )
D = ( x : 0, y : 0.28, z : 0.79196 )
E = ( x : 0.727461, y : 0.42, z : 0 )
F = ( x : 0.42, y : 0.242487, z : 0.685857 )
G = ( x : 0.727461, y : 0.14, z : 0.39598 )
H = ( x : 0.84, y : 0, z : 0 )
I = ( x : 0.727461, y : - 0.42, z : 0 )
J = ( x : 0.42, y : - 0.727461, z : 0 )
K = ( x : 0.242487, y : - 0.7, z : 0.39598 )
L = ( x : 0, y : - 0.84, z : 0 )
M = ( x : - 0.242487, y : - 0.7, z : 0.39598 )
N = ( x : - 0.42, - 0.727461, z : 0 )
O = ( x : - 0.727461, y : - 0.42, z : 0 )
P = ( x : 0, y : 0, z : 0.84 )
Q = ( x : - 0.242487, y : - 0.14, z : 0.79196 )
R = ( x : - 0.84, y : 0, z : 0 )
S = ( x : - 0.727461, y : 0.14, z : 0.39598 )
T = ( x : - 0.42, y : 0.242487, z : 0.685857 )
U = ( x : - 0.727461, y : 0.42, z : 0 )
V = ( x : - 0.484974, y : 0.56, z : 0.39598 )
W = ( x : - 0.42, y : 0.727461, z : 0 )

GOLF BALL

This application claims the priority of Korean Patent Application No. 2004-09756, filed on Feb. 13, 2004, in the Korean Intellectual Property Office, the disclosure of which is incorporated herein by reference in their entirety.

BACKGROUND OF THE INVENTION

1. Field of the Invention

The present invention relates to a golf ball having a dimple arrangement made by a new divisional composition of the spherical outer surface, the golf ball which has the characteristic of fixed landing point after flying with a high trajectory and increased carry distance.

2. Description of the Related Art

In a golf ball, the dimples are arranged by dividing the outer surface into the faces of a spherical polyhedron with the great circle paths. There are many kinds of divisional composition, for example, spherical tetrahedron composed of four spherical triangles, spherical hexahedron composed of six spherical squares, spherical octahedron composed of eight spherical triangles, spherical dodecahedron composed of twelve spherical pentagons, spherical icosahedron composed of twenty spherical triangles. Besides aforementioned divisional composition, the dimples are arranged by further divided polyhedron such as spherical icosidodecahedron composed of spherical twenty triangles and twelve pentagons, and spherical cubeoctahedron composed of six squares and eight triangles. All kinds of the dimple arrangement of the divisional compositions are superimposed each other on the surface of a sphere in the same diameter.

The new dimple arrangements of the golf balls are continuously made by the new divisional compositions in spite of the same situation. The reason is that the surface area of the polygon of polyhedron is different each other in accordance with the kind of divisional composition. So the dimples can be arranged differently in size, depth and shape in the surface of a golf ball. As a result, the aerodynamic characteristic is different between the dimple arrangements by the divisional compositions. And, when the dimples being arranged in the surface of the golf ball by the aforementioned divisional compositions, even in a same polygon of polyhedron, the symmetrically arranged dimples have a good aerodynamic characteristic compare to the non-symmetrically arranged dimples.

The reason is that the golf ball has the aerodynamic stability and has no sway at a low-speed area from the apex of trajectory to the landing point. The dimple coverage which is an important factor for obtaining the sufficient aerodynamic lift that should be more than 76% about the entire surface of a golf ball. But the dimple size is more important factor than others for controlling the flight characteristics. The pressure drag of larger dimples is enlarged in a high-speed area from launching to the apex of trajectory comparing to the small dimples. On the contrary, in a low-speed area from apex to the landing point, the pressure drag of small dimples is increased. But, in case of the average diameter of small dimples is under the 0.140", that is, more than 500 dimples are arranged on the surface of golf ball (the depth of dimples are 0.006"~0.0065") which has a lower trajectory and increased the pressure drag in a low-speed area, so the carry distance is decreased. On the contrary, the average diameter of larger dimples is more than 0.160", that is, less than 350 dimples are arranged on the surface of golf ball (the depth of dimples are 0.006"~0.0065") which has a higher trajectory and rapidly increased the pressure drag in a high-speed area, so the carry distance is decreased. Therefore, recently the dimples are arranged in a combination of large and small diameter. But the larger dimples mostly controlled the character of flight of the golf ball, because the occupied portion of the area of larger dimple is quite larger than the small one on the surface of the golf ball.

Accordingly, new divisional compositions of the spherical outer surface of a golf ball are required to obtain stable and uniform landing point and increase the carrying distance, with the requisition for research on effective arrangements of dimples on the divided surface of the golf ball.

SUMMARY OF THE INVENTION

The present invention provides a golf ball that has characteristics of stable and uniform landing point and increased carrying distance by making the dimple arrangement by the new divisional composition which is easily arranged symmetrically in a polygon itself on the surface of the golf ball which has an aerodynamic stability.

BRIEF DESCRIPTION OF THE DRAWINGS

This invention will be explained in conjunction with an illustrative embodiment shown in the accompanying drawing, in which.

DETAILED DESCRIPTION OF THE INVENTION

A golf ball having a new divisional composition according to the present invention will now be described more fully with reference to the accompanying drawings, in which exemplary embodiments of the invention are shown.

Figure 1:
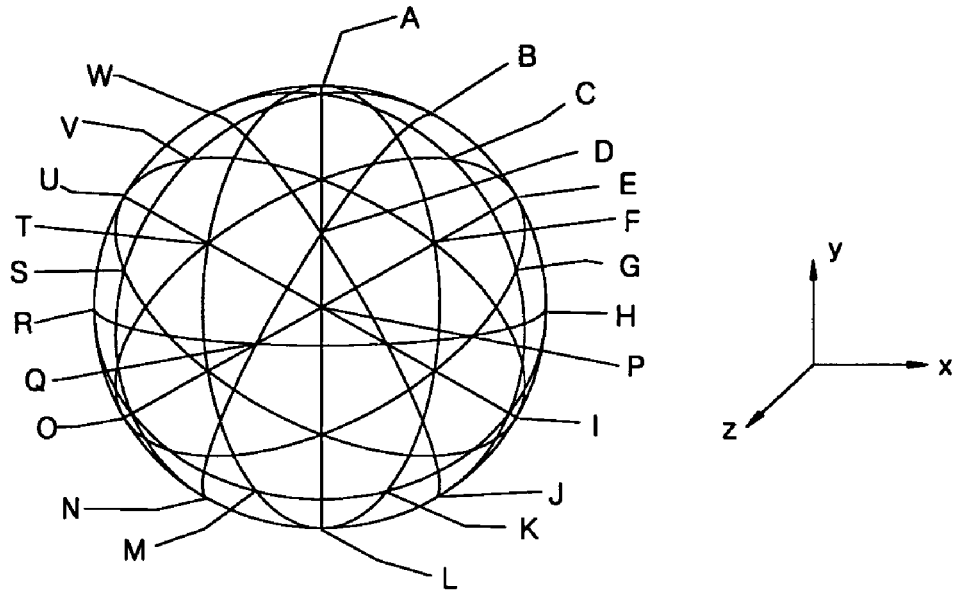
FIG. 1 is a polar view of the surface of a golf ball according to the present invention, the surface which is divided by the great circle paths, and illustrates the great circle paths passing through the positions which represented as 3-D coordinates (for example, 3-D coordinates of A is illustrated by x=0, y=0.84, z=0)

FIG. 1 is a polar view of the surface of a golf ball according to the present invention, the surface which is divided by the great circle paths, and illustrates the great circle paths passing through the positions which represented as 3-D coordinates. For example, 3-D coordinates of A is illustrated by x=0, y=0.84, z=0.

FIG. 1 exemplarily illustrates the golf ball, which has a plurality dimples arranged on the spherical outer surface of the sphere divided by a great circle path (11 in FIG. 2) which passes through the points A (3-D coordinates x: 0, y: 0.84, z: 0), P (3-D coordinates x: 0, y: 0, z: 0.84) and L (3-D coordinates x: 0, y: −0.84, z: 0), while an arbitrary point P on the surface of the golf ball acts as a pole in FIG. 1, a great circle path (12 in FIG. 2) which passes through the points E (3-D coordinates x: 0.727461, y: 0.42, z: 0), P (3-D coordinates x: 0, y: 0, z: 0.84) and O (3-D coordinates x:

−0.727461, y: −0.42, z: 0) in FIG. 1, a great circle path (13 in FIG. 2) which passes through the points I (3-D coordinates x: 0.727461, y: −0.42, z: 0), P (3-D coordinates x: 0, y: 0, z: 0.84) and U (3-D coordinates x: −0.727461, y: 0.42, z: 0) in FIG. 1, a great circle path (22 in FIG. 2) which passes through the points B (3-D coordinates x: 0.42, y: 0.727461, z: 0), D (3-D coordinates x: 0, y: 0.28, z: 0.79196) and N (3-D coordinates x: −0.42, y: −0.727461, z: 0) in FIG. 1, a great circle path (21 in FIG. 2) which passes through the points W (3-D coordinates x: −0.42, y: 0.727461, z: 0), D (3-D coordinates x: 0, y: 0.28, z: 0.79196) and J (3-D coordinates x: 0.42, y: −0.727461, z: 0) in FIG. 1, a great circle path (23 in FIG. 2) which passes through the points R (3-D coordinates x: −0.84, y: 0, z: 0), Q (3-D coordinates x: −0.242487, y: −0.14, z: 0.79196) and H (3-D coordinates x: 0.84, y: 0, z: 0) in FIG. 1, a great circle path (41 in FIG. 2) which passes through the points A (3-D coordinates x: 0, y: 0.84, z: 0), T (3-D coordinates x: −0.42, y: 0.242487, z: 0.685857) and L (3-D coordinates x: 0, y: −0.84, z: 0) in FIG. 1, a great circle path (42 in FIG. 2) which passes through the points A (3-D coordinates x: 0, y: 0.84, z: 0), F (3-D coordinates x: 0.42, y: 0.242487, z: 0.685857) and L (3-D coordinates x: 0, y: −0.84, z: 0) in FIG. 1, a great circle path (45 in FIG. 2) which passes through the points E (3-D coordinates x: 0.727461, y: 0.42, z: 0), T (3-D coordinates x: −0.42, y: 0.242487, z: 0.685857) and O (3-D coordinates x: −0.727461, y: −0.42, z: 0) in FIG. 1, a great circle path (46 in FIG. 2) which passes through the points E (3-D coordinates x: 0.727461, y: 0.42, z: 0), G (3-D coordinates x: 0.727461, y: 0.14, z: 0.39598) and O (3-D coordinates x: −0.727461, y: −0.42, z: 0) in FIG. 1, a great circle path (43 in FIG. 2) which passes through the points I (3-D coordinates x: 0.727461, y: −0.42, z: 0), F (3-D coordinates x: 0.42, y: 0.242487, z: 0.685857) and U (3-D coordinates x: −0.727461, y: 0.42, z: 0) in FIG. 1, a great circle path (44 in FIG. 2) which passes through the points I (3-D coordinates x: 0.727461, y: −0.42, z: 0), S (3-D coordinates x: −0.727461, y: 0.14, z: 0.39598) and U (3-D coordinates x: −0.727461, y: 0.42, z: 0) in FIG. 1, a great circle path (31 in FIG. 2) which passes through the points B (3-D coordinates x: 0.42, y: 0.727461, z: 0), V (3-D coordinates x: −0.484974, y: 0.56, z: 0.39598) and N (3-D coordinates x: −0.42, y: −0.727461, z: 0) in FIG. 1, a great circle path (33 in FIG. 2) which passes through the points R (3-D coordinates x: −0.84, y: 0, z: 0), M (3-D coordinates x: −0.242487, y: −0.7, z: 0.39598) and H (3-D coordinates x: 0.84, y: 0, z: 0) in FIG. 1, and a great circle path (32 in FIG. 2) which passes through the points W (3-D coordinates x: −0.42, y: 0.727461, z: 0), G (3-D coordinates x: 0.727461, y: 0.14, z: 0.39598) and J (3-D coordinates x: 0.42, y: −0.727461, z: 0) in FIG. 1.

Meanwhile, considering that a diameter of a golf ball according to normal standards is 0.84 inch, it is possible to apply the numbers represented in the coordinates of FIG. 1 in inches to a golf ball of a 0.84 inch diameter.

However, since the numbers represented in FIG. 1 express proportions among the coordinates, if a measured diameter of a golf ball is slightly greater or less than 0.84 inch, real coordinate values of each coordinate are calculated by multiplying the abovementioned coordinate values by a proportional constant that is obtained by dividing the measured diameter by 0.84 inch.

Hereinafter, larger dimples, 0.19"~0.20" diameter, being arranged symmetrically even in a polygon itself of the polyhedron which made by the aforementioned divided method of the spherical outer surface of a golf ball will be described.

Figure 2:
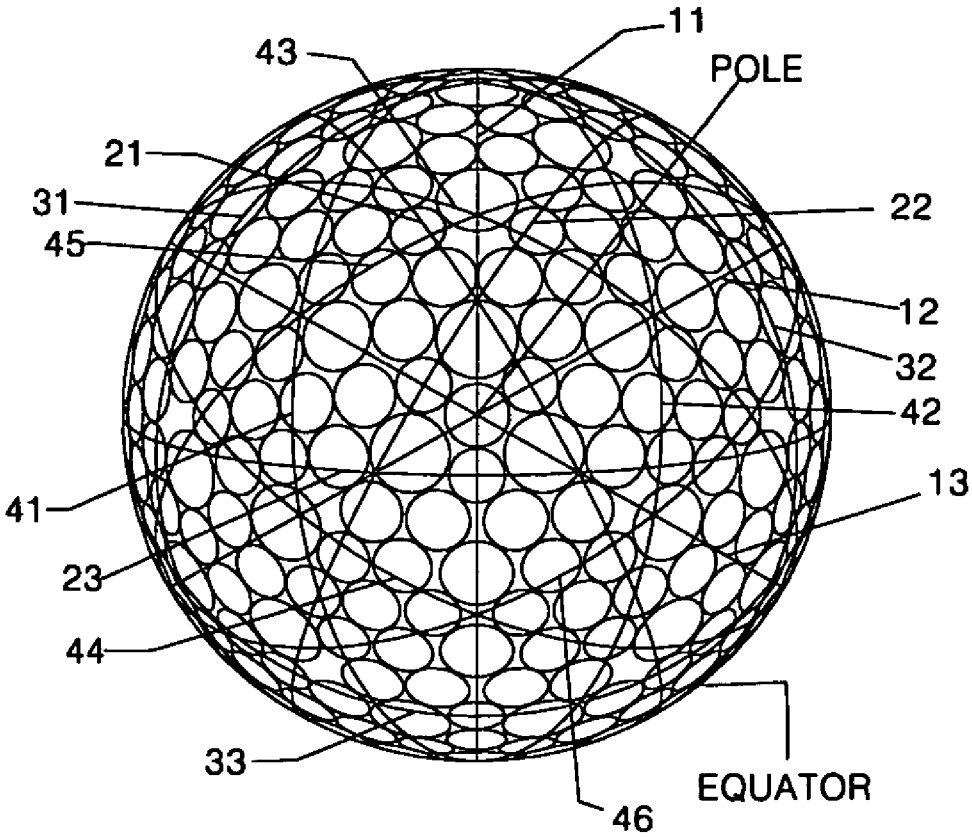
FIG. 2 is a polar view of the surface of a golf ball according to the present invention, the great circle paths which divided the surface of sphere and the dimples are arranged by the divisional composition.
Figure 3:
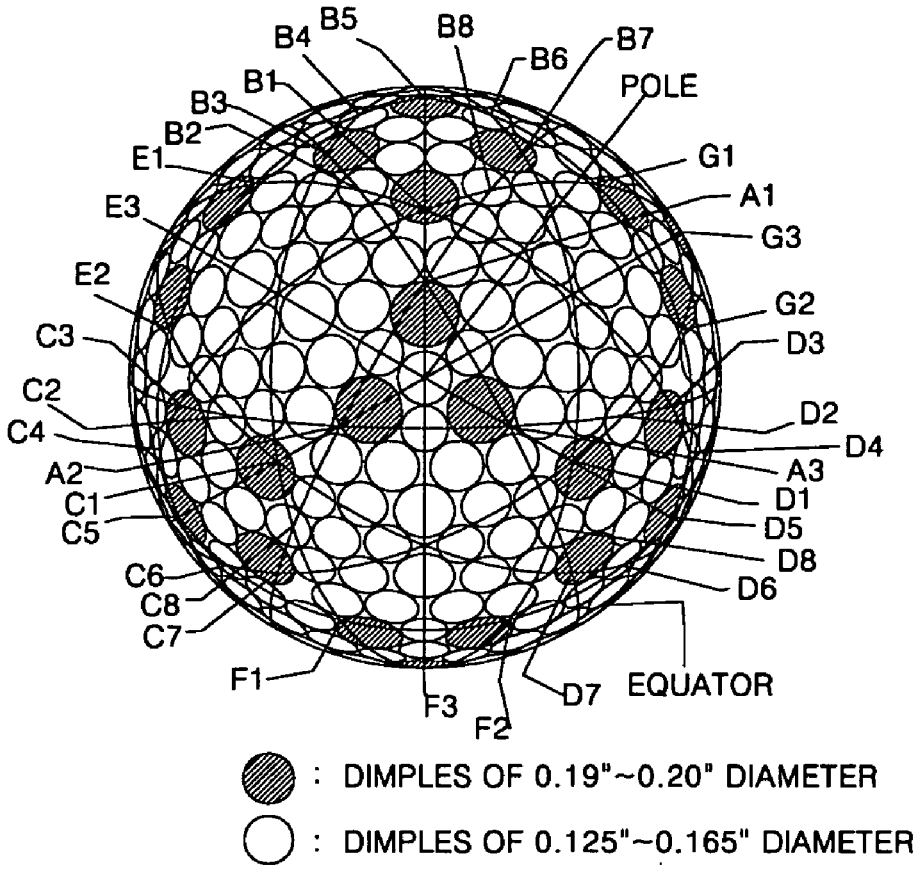
FIG. 3 shows the polygons which made by the great circle paths according to this invention, the arrangement of the larger dimples which controlled the flight characteristics exist on the triangles and octagons among the polygons, and illustrated the vertices of triangles and octagons.

The larger dimples, 0.19"~0.20" diameter, are arranged symmetrically each other as shown in FIG. 3 around the apices of the spherical triangle (illustrated by the apices A1, A2, A3 in FIG. 3) which made by the great circle paths 21, 22 and 23 in FIG. 2, arranged around the apices of the spherical triangle (illustrated by the apices G1, G2, G3 in FIG. 3) which made by the great circle paths 32, 45 and 46 in FIG. 2, arranged around the apices of the spherical triangle (illustrated by the apices E1, E2, E3 in FIG. 3) which made by the great circle paths 31, 43 and 44 in FIG. 2, and arranged around the apices of the spherical triangle (illustrated by the apices F1, F2, F3 in FIG. 3) which made by the great circle paths 33, 41 and 42 in FIG. 2. And also, The larger dimples, 0.19"~0.20" diameter, are arranged symmetrically each other as shown in FIG. 3 around the four of eight apices of the spherical octagon (illustrated by the apices B1, B2, B3, B4, B5, B6, B7, B8 in FIG. 3) which made by the great circle paths 31, 32, 41, 42, 21, 22, 43 and 45 in FIG. 2, arranged around the four apices of the spherical octagon (illustrated by the apices C1, C2, C3, C4, C5, C6, C7, C8 in FIG. 3) which made by the great circle paths 31, 33, 45, 46, 22, 23, 41 and 44 in FIG. 2, and arranged around the four apices of the spherical octagon, which are not adjacent to one another, (illustrated by the apices D1, D2, D3, D4, D5, D6, D7, D8 in FIG. 3) which made by the great circle paths 32, 33, 43, 44, 21, 23, 42 and 46 in FIG. 2.

As shown in FIG. 3, other dimples, 0.125"~0.165" diameter, are arranged in surfaces other than the surface in which the larger dimples, 0.19"~0.20" diameter, are arranged.

Preferably, the dimples arranged on the surface of the golf ball have 4~6 kinds of diameter.

Figure 4:
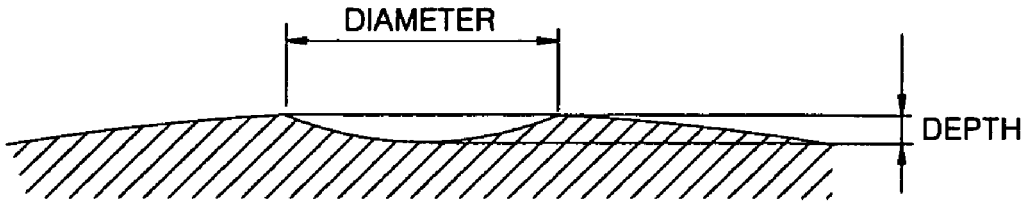
FIG. 4 shows the depth about the diameter of dimple.

The larger dimples and smaller dimples can have different depths or the same depth (refer to FIG. 4). Preferably, the depth of each of the dimples ranges from 0.006 to 0.0065 inch.

Meanwhile, although FIGS. 1 through 3 each illustrate only one hemisphere of the golf ball, the surface of the other hemisphere thereof can also be divided by the aforementioned divisional compositions, and spherical triangles and spherical octagons can be arranged in the same manner as the hemisphere shown in FIGS. 1 through 3.

The dimple arrangement as mentioned above that provides the golf ball having an aerodynamic stability, so the landing point is stable and uniform, and the carry distance has increased.

While the present invention has been particularly shown and described with reference to preferred embodiments thereof, it will be understood by those of ordinary skill in the art that various changes in form and details may be made therein without departing from the spirit and scope of the present invention as defined by the following claims.

What is claimed is:

1. A golf ball having a plurality of dimples arranged its spherical outer surface divided by a great circle path which passes through the points A (3-D coordinates x: 0, y: 0.84, z: 0), P (3-D coordinates x: 0, y: 0, z: 0.84) and L (3-D coordinates x: 0, y: −0.84, z: 0), while an arbitrary point P acts as a pole, a great circle path which passes through the points E (3-D coordinates x: 0.727461, y: 0.42, z: 0), P (3-D coordinates x: 0, y: 0, z: 0.84) and 0 (3-D coordinates x: −0.727461, y: −0.42, z: 0), a great circle path which passes through the points I (3-D coordinates x: 0.727461, y: −0.42, z: 0), P (3-D coordinates x: 0, y: 0, z: 0.84) and U (3-D coordinates x: −0.727461, y: 0.42, z: 0), a great circle path which passes through the points B (3-D coordinates x: 0.42, y: 0.727461, z: 0), D (3-D coordinates x: 0, y: 0.28, z: 0.79196) and N (3-D coordinates x: −0.42, y: −0.727461, z:

0), a great circle path which passes through the points W (3-D coordinates x: −0.42, y: 0.727461, z: 0), D (3-D coordinates x: 0, y: 0.28, z: 0.79196) and J (3-D coordinates x: 0.42, y: −0.727461, z: 0), a great circle path which passes through the points R (3-D coordinates x: −0.84, y: 0, z: 0), Q (3-D coordinates x: −0.242487, y: −0.14, z: 0.79196) and H (3-D coordinates x: 0.84, y: 0, z: 0), a great circle path which passes through the points A (3-D coordinates x: 0, y: 0.84, z: 0), T (3-D 20 coordinates x: −0.42, y: 0.242487, z: 0.685857) and L (3-D coordinates x: 0, y: −0.84, z: 0), a great circle path which passes through the points A (3-D coordinates x: 0, y: 0.84, z: 0), F (3-D coordinates x: 0.42, y: 0.242487, z: 0.685857) and L (3-D coordinates x: 0, y: −0.84, z: 0), a great circle path which passes through the points E (3-D coordinates x: 0.727461, y: 0.42, z: 0), T (3-D coordinates x: −0.42, y: 0.242487, z: 0.685857) and 0 (3-D coordinates x: −0.727461, y: −0.42, z: 0), a great circle path which passes through the points E (3-D coordinates x 0.727461, y: 0.42, z: 0), G (3-D coordinates x: 0.727461, y: 0.14, z: 0.39598) and 0 (3-D coordinates x: −0.727461, y: −0.42, z: 0), a great circle path which passes through the points I (3-D coordinates x: 0.727461, y: −0.42, z: 0), F (3-D coordinates x: 0.42, y: 0.242487, z: 0.685857) and U (3-D coordinates x: −0.727461, y: 0.42, z: 0), a great circle path which passes through the points I (3-D coordinates x: 0.727461, y: −0.42, z: 0), S (3-D coordinates x: −0.727461, y: 0.14, z: 0.39598) and U (3-D coordinates x: −0.727461, y: 0.42, z: 0), a great circle path which passes through the points B (3-D coordinates x: 0.42, y: 0.727461, z: 0), V (3-D coordinates x: −0.484974, y: 0.56, z: 0.39598) and N (3-D coordinates x: −0.42, y: −0.727461, z: 0), a great circle path which passes through the points R (3-D coordinates x: −0.84, y: 0, z: 0), M (3-D coordinates x: −0.242487, y: −0.7, z: 0.39598) and H (3-D coordinates x: 0.84, y: 0, z: 0), and a great circle path which passes through the points W (3-D coordinates x: −0.42, y: 0.727461, z: 0), G (3-D coordinates x: 0.727461, y: 0.14, z: 0.39598) and J (3-D coordinates x: 0.42, y: −0.727461, z: 0).

2. The gold ball of claim 1 wherein the dimples define polygons including spherical triangles and octagons, and include larger dimples of approximately 0.19~0.20 inch diameter, which larger dimples are arranged symmetrically around the three apices of at least one triangle and around four of the apices of at least one octagon.

3. The golf ball of claim 1, wherein the dimples arranged on the spherical surface have 4~6 kinds of diameter.

4. The golf ball of claim 1, wherein the dimples arranged on the spherical surface are identical in depths.

5. The golf ball of claim 1, wherein the dimples arranged on the spherical surface have various depths.

* * * * *